United States Patent [19]

Mauritz

[11] 4,097,032

[45] Jun. 27, 1978

[54] FOREHEARTH WITH WEIR, PARTICULARLY FOR USE IN A BASALT SMELTING FURNACE

[75] Inventor: Wonter Mauritz, Bad Honnef, Germany

[73] Assignee: Schmelzbasaltwerk Kalenborn, Dr. Ing. Mauritz Kg, Kalenborn, Germany

[21] Appl. No.: 773,852

[22] Filed: Mar. 3, 1977

[51] Int. Cl.[2] ..... F27D 15/00

[52] U.S. Cl. ..... 266/230; 266/166; 266/240

[58] Field of Search ..... 164/134, 335; 13/33; 432/161; 266/166, 227, 229, 230, 240

[56] References Cited

U.S. PATENT DOCUMENTS

| | | | |
|---|---|---|---|
| 848,840 | 4/1907 | Moore | 266/229 |
| 2,435,696 | 2/1948 | Pluta et al. | 266/230 |
| 2,718,389 | 9/1955 | Perrin | 266/230 |
| 3,389,898 | 6/1968 | Schimmel et al. | 266/166 |
| 3,706,449 | 12/1972 | Anderson et al. | 266/240 |

*Primary Examiner*—Gerald A. Dost

[57] ABSTRACT

A forehearth of a smelting furnace which includes a weir used in conjunction with a float essentially in the form of a U disposed in a horizontal position, with the opening of the U disposed adjacent to the discharge opening of the weir, the float having a thickness sufficient to act to dam or stop passage of molten material from the forehearth through the weir, but allowing such molten material to pass under the float, and through the opening of the U, and thence through the discharge weir.

11 Claims, 4 Drawing Figures

FIG.3
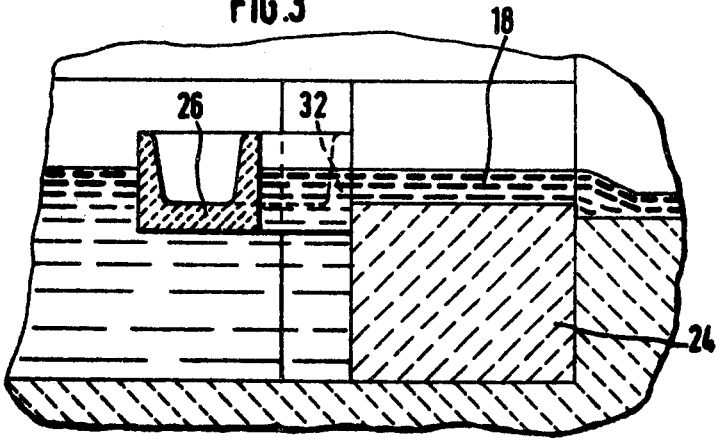
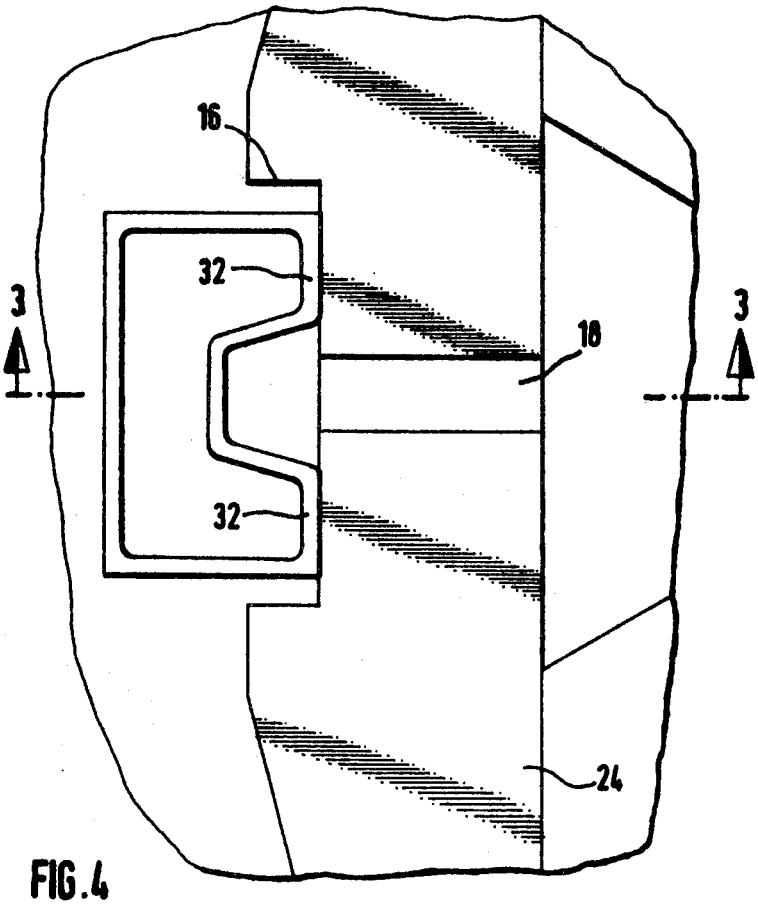
FIG.4

FOREHEARTH WITH WEIR, PARTICULARLY FOR USE IN A BASALT SMELTING FURNACE

DESCRIPTION OF THE INVENTION

This invention relates to a forehearth having a discharge weir particularly intended for use on a basalt smelting furnace.

In certain smelting operations, particularly that of basalt, the molten mass of material to be cast requires close control with respect to the casting of the molten material into various molds. It is desirable to have a forehearth which permits a variable outflow of molten material, while maintaining a constant inflow. The surface of the molten material develops bubbles and solidified impurities in the form of slag, which are to be prevented from entering into the casting mold. Tippable forehearths are generally known, although these are not used in the smelting of basalt, and in these, when a dam is immersed in the molten material to hold back the slag and the skin which is formed on the surface of the molten material, and a siphon effect permits discharge of the molten material. Forehearths of this type have not previously been used in connection with the smelting of basalt. As to whether such constructions would function satisfactorily in connection with the smelting of basalt is open to question.

The present invention achieves a siphon effect of discharge of molten material through a weir without the necessity of utilizing the conventional form of dams previously known in other foundry fields, which dams have associated disadvantages, as for example, being very difficult to clean.

The present invention overcomes the problems and disadvantages of prior constructions in a simple manner by providing a free-floating float in the forehearth outlet.

A preferred embodiment of the float is hollow in construction. In connection with molten basalt, the float is formed of hardened fire-clay. Taking into consideration the form of the float generally, the material of which it is formed is selected with respect to the depth of the molten material in the hearth, and specifically, the float is designed so that it would be preferably immersed in molten material to an extent of approximately five-eighths of its height.

The float is constructed in a box-like form and is of moderate depth or thickness, and on the forehearth discharge side, the float has a vertical flow passage, such that, in a plan view, it has a bridge-arch form which might generally be defined as a U-shape.

The float is laterally and loosely held in a recessed area defined by the jaws of the weir, the jaws forming part of the inner wall of the weir facing the float.

Preferably, the forehearth has some degree of adjustability of inclination, by means of a knive-edge suspension.

In the present invention, it is advantageous if the float transit opening is greater than the discharge opening in the weir. A ratio of approximately 7:5 of the median transit passage width of the float to the discharge channel width of the weir can be selected as a preferred value.

The forehearth is produced of steel and includes a fireproof lining to withstand the effects of the molten material contained therein.

The basic form of the forehearth can be similar to that of a conventional casting ladle.

With regard to capacity of the forehearth, as is contemplated in the present invention, this would preferably be of such size as to receive up to 1.5% of the smelting output of the furnace per day. The knive-edge suspension for the forehearth would be disposed not far below the float.

For emptying the forehearth, an additional opening, situated at the level of the forehearth bottom surface, is provided in a lateral wall, in a conventional manner.

One of the essential advantages of the present invention resides in the fact that only material from a specific layer height of molten material in the forehearth can be discharged through the weir. Furthermore, it is an important aspect of this invention that immediately after finishing a casting operation, the float can be removed and does not constitute an element upon which slag and solidifying casting material can become encrusted. The invention further would permit exchange or replacement of the float during the smelting operation.

In operation, molten material in the forehearth flows as through a siphon, under the float, and into the opening of the float, and through the weir through the discharge channel.

By means of the proper selection of the ratio of the size of the float to the size of the passage opening, any suction effect on the float can be avoided. Therefore, no surface skin or floating slag need enter into the casting.

The float is secured in position laterally, and loosely at its forward end, by jaws in the fireproof lining of the weir, and the rear end of the float is held in position by the slip stream of the molten material.

A typical embodiment of the present invention will now be described, having reference to the accompanying drawings in which:

FIG. 3 shows an embodiment detail in cross-section taken along the axis 3—3 of FIG. 4; and FIG. 4 is an embodiment detail of FIG. 3 in a plan view.

Figure 1:
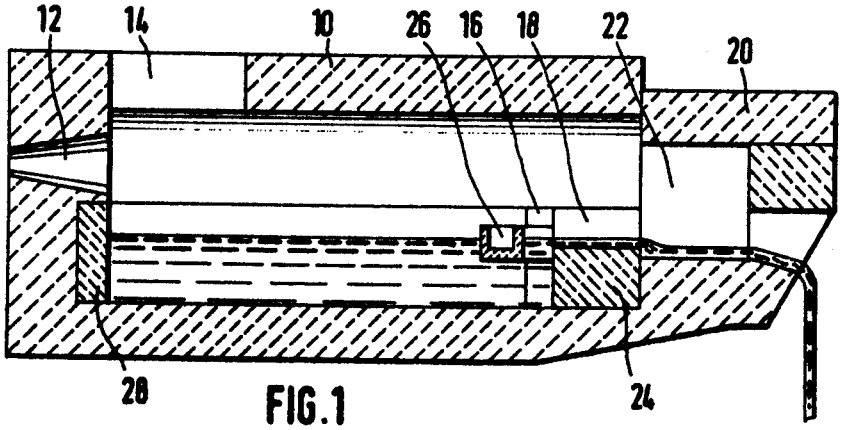
FIG. 1 shows a section through the forehearth.
Figure 2:
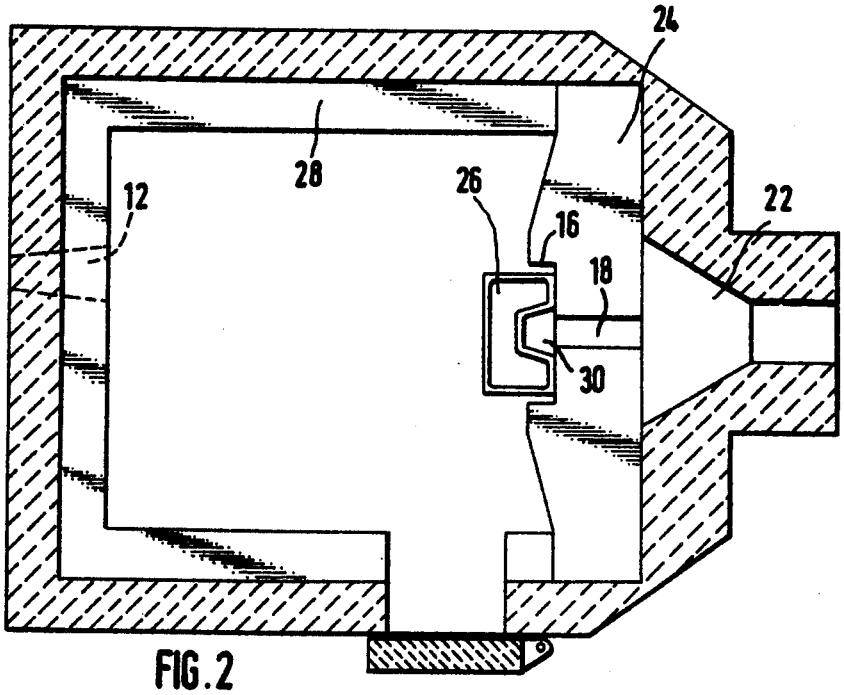
FIG. 2 is a sectional plan view of corresponding FIG. 1.

Having reference to FIG. 1, the funnel 14 allows molten material to pass out of the smelting furnace into the forehearth generally designated by reference numeral 10. The forehearth has the approximate shape of an elongated flat casting ladle and includes a fireproof lining 28 on its inner walls. For purposes recognized in the metallurgy art, the inside ceiling of the forehearth is vault-like in form. In the region of the forehearth outlet, a weir 24 with a discharge channel 18, is provided. The weir 24 has an inner wall being formed of two lateral jaws 16, defining a centrally disposed recess therebetween.

At the opposite end of the forehearth, a rewarming burner is provided for maintaining heat to the molten material. As shown in FIG. 1, there is a mass of molten material in the forehearth, and the forehearth outlet is partially blocked, in a novel way, according to the present invention, by the free-floating float 26, which is pressed against the outlet of the forehearth by the pressure of the molten material in the forehearth, and the float is held laterally and loosely by jaws 16. A front end portion of the float is constantly and loosely held within the depth of the central recess defined by the jaws 16. The molten material located in the forehearth flows under the float 26, flows upwardly in the float transit passage 30, and subsequently flows through the discharge opening channel 18 in the weir 24, and there-after flows through the front chamber 22, and finally to a casting mold of some selected type.

The front chamber has a top surface cover 20.

A detailed view of the form of the float is depicted in FIGS. 3 and 4 of the drawings, where the float is shown to be box-like in form, of relatively shallow depth, and having a vertical transit passage at the weir discharge channel, so that in plan view, the float has a bridge-arch form, or might generally be described as U-shaped. The two shanks 32 of the float brace against the central recess of the weir inner wall, facing the float.

typical ratio of dimensions of the float length to width to depth is 10 to 6 to 2.6. According to the typical embodiment described here, the dimensions would be length, 300 mm., width, 180 mm., and depth, 80 mm. The wall thickness would be approximately 1.5 cm. in the embodiment disclosed.

The transit passage of the float is constructed in the form of a truncated cone, the broad base of the truncated cone pointing toward the weir 24. With a discharge channel width of 6 cm. in the weir, the wide transit opening of the float would come to approximately 12 cm., in a plan view, and approximately 8 cm. at the narrow side of the truncated cone, with a depth of the transit opening along the axis in FIG. 4 of 8 cm., with a wall thickness of approximately 1.5 cm.

The float is generally open at the top, rather than of solid construction. When the molten material is basalt, the float is preferably of hardened fire-clay.

When molten material is to flow off from a particular layer height, or depth, it is possible for a float of different form and/or thickness to be provided, so long as the abovementioned suction remains small enough. In the example shown here, the immersion depth of the float in the molten material amounts to approximately five-eighths of the total float height, and it has been shown that this is highly preferred.

By means of the present invention, it is possible to achieve a casting control of molten material with surprisingly simple means. The flow-off is readily variable by inclining the forehearth. The quality of the material flowing from the outlet always remains the same, since it flows off from the same layer depth of the molten material, an advantage which cannot be achieved with fixed dams, for instance, for the casting of cast iron.

On the basis of the inventive float construction described, it is possible to substantially simplify the forehearth construction and to make it less expensive.

In a top view, the proposed float has a U-shaped construction, the recess of the U between the shanks being conical and rounded-off, and the float being of essentially hollow construction having an open top. In cross-section as well, transversely to its longitudinal axis, the float will be of U-shaped cross-section, the shanks of the U also being conical, that is, the vertical free space between the shanks being uniformly shaped throughout its entire length, having the shape of an inverted trapezoid, with rounded corners. In a top view, both shanks 32 of the U have a relatively wide contact surface for bracing against the weir 24.

The forehearth might include a lateral "melt-out opening" through which the float can be observed, and if necessary, exchanged or replaced. This opening, when not used, is walled up with fireproof material to prohibit discharge of molten mass from within.

The ratio of the transit opening on the float to the discharge opening in the weir can generally be indicated as 2:1.

The forehearth generally consists of a sheet metal construction with an insulating lining, to which is added a lining of fireproof material, preferably of molten or sintered corundum bricks. The weir itself consists of molten-cast corundum bricks.

What is claimed is:

1. A foundry forehearth for collecting molten material to be cast, comprising a weir disposed at the discharge end of the forehearth, said weir having a channel transversing the top surface thereof, for discharging molten material into the discharge end of the forehearth, a free-floating float being many times smaller than the forehearth and having a U-shaped cross-section, said float bracing against said weir and defining a transit passage therebetween leading to said channel, said transit passage being uniformly shaped throughout its entire length, the cross-section thereof, transversally to its longitudinal axis, having an inverted trapezoid configuration, and said weir comprising a pair of jaws defining a centrally disposed recess in the wall of said weir facing said float, a portion of said float being loosely held within the depth of said centrally disposed recess, such that said float is continuously free-floating even when it is forced against said weir under the pressure of the molten material.

2. A forehearth as claimed in claim 1, wherein said float has a generally U-shaped lateral configuration, as well as a generally U-shaped vertical cross-section.

3. A forehearth as claimed in claim 1, wherein said float is of essentially hollow construction and consisting essentially of two parallel leg members defining a vertical transit passage and bracing against said weir.

4. A forehearth as claimed in claim 1, wherein said transit passage is larger than said channel.

5. A forehearth as claimed in claim 1, wherein the ratio of dimensions of said transit passage to said channel is 7:5.

6. A forehearth as claimed in claim 1, wherein the forehearth has a degree of inclination that is adapted to be varied so as to provide variable flow through the discharge end of the forehearth.

7. A forehearth as claimed in claim 1, wherein the configuration, thickness, and material used in construction of said float are dependent on the characteristics of the molten material poured into and discharged from the forehearth.

8. A forehearth as claimed in claim 7, wherein said float is made of hardened fire clay and the molten material consists of basalt.

9. A forehearth as claimed in claim 1, wherein said float is made of hardened fire clay and the ratio of dimensions of the length, width, and depth thereof is 10 to 6 to 2.6, and wherein the molten material consists of basalt.

10. A forehearth according to claim 1, wherein all the molten material discharged from the forehearth originates from the same layer depth of the molten material within the forehearth, so that the molten material discharged from the forehearth is constantly maintained at the same quality.

11. A forehearth as claimed in claim 1, wherein said float is constructed of a material of such density as will permit approximately five-eighths of the vertical dimension of said float to be submerged in the molten material within the forehearth.

* * * * *